United States Patent [19]

Miller et al.

[11] 4,454,205

[45] Jun. 12, 1984

[54] METHOD OF DRILL BIT MANUFACTURE AND PRODUCT

[75] Inventors: Ronald R. Miller, Beaverton; William R. Barber, Jr., Portland, both of Oreg.; David A. Hampel, Vancouver, Wash.; James E. Ault, Portland, Oreg.

[73] Assignee: ESCO Corporation, Portland, Oreg.

[21] Appl. No.: 310,226

[22] Filed: Oct. 9, 1981

[51] Int. Cl.[3] ..... B22F 7/08

[52] U.S. Cl. ..... 428/556; 428/553; 428/554; 428/555; 428/627; 164/111; 427/249

[58] Field of Search ..... 164/111; 427/249; 428/553, 554, 555, 556, 558, 627

[56] References Cited

U.S. PATENT DOCUMENTS

| | | | |
|---|---|---|---|
| 684,359 | 10/1901 | Vair | 164/111 |
| 3,554,782 | 8/1967 | Nieberlein | 427/249 |
| 3,790,353 | 2/1974 | Jackson et al. | 75/240 |
| 3,832,221 | 8/1974 | Ekemar | 427/249 |
| 4,035,541 | 7/1977 | Smith et al. | 428/217 |
| 4,101,318 | 7/1978 | Rudy | 75/240 |
| 4,187,626 | 2/1980 | Greer et al. | 37/141 R |

FOREIGN PATENT DOCUMENTS

| | | | |
|---|---|---|---|
| 134719 | 10/1979 | Japan | 428/627 |

*Primary Examiner*—Brooks H. Hunt

*Attorney, Agent, or Firm*—Tilton, Fallon, Lungmus & Chestnut

[57] ABSTRACT

A method for making a drill bit and product resulting therefrom in which carbide elements are coated with carbide and nitride materials such as those of titanium as by chemical vapor deposition after which the elements are cast in molten steel.

12 Claims, No Drawings

METHOD OF DRILL BIT MANUFACTURE AND PRODUCT

BACKGROUND OF INVENTION

This invention relates to a method of manufacture of a drill bit and product resulting therefrom and, more particularly, one that finds advantageous application to oil well drilling.

Contemporary drill bits employ tungsten carbide inserts in steel cone-shaped bodies. The hardness achieved by the tungsten carbide is highly desirable to insure satisfactory life of the drill bits. When it is considered that often these bits are operated many thousands of feet below the surface, anything that extends the life of the bit is desirable because of the extraordinary cost in removal and replacement of the bit. The carbide-equipped cone bits are uniformly manufactured by providing holes in the steel body which are carefully monitored so as to receive and support the carbide inserts. A number of disadvantages flow therefrom in addition to the obvious high cost because of the labor intensive operation. One significant disadvantage is that a substantial amount of carbide must be employed in order to achieve a suitable anchor of the carbide to the supporting bit body. This in turn generates another disadvantage because the amount of space occupied by the carbide limits the space available for the bearings, i.e., the members normally required to permit the cone shaped portions of the bit to rotate during the drilling operation. Thus, in many cases, the life of the bearings determine the life of the bit so that in the past it has been a continuing battle between the carbides and the bearings as to which would outlast the other and therefore prolong the life of the bit itself.

In the past, consideration has been given to the use of integrally cast carbides for the purpose of overcoming certain of the foregoing disadvantages. However, these have been uniformly unsuccessful. Characteristic of integrally cast carbides is the so-called "halo effect" due to any element migration and the development of the eta phase due to carbon starvation. This has been overcome by the instant invention and the provision of an integrally cast drill bit cone constitutes an important objective of the invention.

SUMMARY OF INVENTION

According to the invention, a superior performing drill bit is provided through integrally casting the carbide elements in the conical steel bodies of the bit. More particularly, this is achieved by coating the carbide element prior to casting so as to effect a strong, defect-free bond between the steel of the body and the carbide elements. Advantageously, the coating of the carbide elements prior to casting may take the form of high temperature carbides and nitrides such as those of titanium, hafnium and silicon. These cations are found in groups III and IV of the Periodic Table. The coating can be suitably achieved through the use of chemical vapor deposition although other application modes may be utilized.

Other objects and advantages of the invention may be seen in the details of the ensuing specification.

DETAILED DESCRIPTION

The invention is described in conjunction with the following examples.

EXAMPLE 1

This was performed for the purpose of making a rotary drill bit of conventional design where three conical cutter bodies are journalled on a drill bit body. The drill bit itself or supporting structure is normally forged so that any carbides or hard facing applied thereto has to be performed other than by casting. The instant invention is concerned with the cutter bodies, normally three in number, which are journalled on the forged bit body.

Normally 20 to 60 carbide elements are provided on each of the conical cutter bodies. These are arranged in various patterns determined by the geometric design and application of the drill bit.

The carbide elements are advantageously free of any sharp corners which would become internal of the conical cutter body. This is in studied contrast to the prior art where the carbide elements are normally bullet shaped with flat bases so as to fit precisely within the machined holes.

More particularly, the invention makes possible the use of contours of carbide elements which do not have to be pressed into previously machined openings and thus can take the shape of frusto-conical elements, for example, whereby an additional internal lock or latching is achieved. In any event, the diverse shaped carbide elements which normally are upwards of about 90% tungsten carbide with the remainder being cobalt, are subjected to chemical vapor deposition of titanium nitride and titanium carbide. These coating ingredients are deposited in the illustration given at a temperature of about 1750° F. in an insulated retort. The optimum coating is made up of a number of layers in the following order proceeding outwardly from the carbide element. The overall thickness of the applied coating in this Example was 18 microns. Coating thicknesses in the range of about 10 to about 50 microns are preferred. Thereafter, the elements were removed from the retort and cooled to room temperature.

Casting was achieved by conventional shell molding technique wherein the coated carbide elements were mounted in the shell with the wider bases projecting inwardly. Molten steel at a temperature of 2700°–2900° F. was introduced into the shell mold. The steel employed was EX-55 which is a conventional steel employed in the oil well drilling industry.

After cooling, the cutter body was subjected to a carburizing treatment in order to harden the internal area which ultimately serves as the bearing race.

Examination of specimens from the developed cutter body under a scanning electron microscope revealed the absence of any Eta phase in the carbide. Further, there was no migration of elements from the carbide into the steel and vice versa. More particularly, the titanium carbide/nitride coating remained substantially intact. Further, there were no voids present at the interface of the carbide element with the steel body which normally would occur from sharp corners which develop hot spots which result in shrinkage and void development upon cooling.

EXAMPLE 2

The procedure of Example 1 was followed with equal success for the production of both percussion drill bits, stabilizers and reamers. In each of these, the chemistry and metallurgy is the same but the geometry somewhat different.

EXAMPLE 3

Also exemplary of the practice of the invention as a suitable coating are silicon carbide and hafnium carbide with or without the presence of the corresponding nitride. On the other hand, coatings of carbon, nickel and aluminum oxide were found inoperative for the purpose of the invention as also were sleeves made of stainless steel for partially jacketing the carbide elements.

While in the foregoing specification a detailed description of the invention has been set down for the purpose of explanation, many variations in the details herein-given may be made by those skilled in the art without departing from the spirit and scope of the invention.

I claim:

1. A method of providing a bit body suitable for drilling and the like comprising the steps of providing a plurality of tungsten carbide elements, coating the same with a carbide compound wherein the cation is selection from groups III and IV of the Periodic Table, and casting the same in molten steel to support the elements in partially exposed condition, said elements having a contour to provide an internal lock with said steel.

2. The method of claim 1 in which the said elements are characterized by the absence of sharp corners internally of the completed bit body.

3. The method of claim 2 in which the said elements are larger at the internal portions thereof to provide a lock-in feature.

4. The method of claim 1 in which the coating is achieved by chemical vapor deposition.

5. The method of claim 4 in which the coating includes titanium carbide and titanium nitride.

6. The method of claim 1 in which said bit body is a conical cutter body equipped with a plurality of said elements and internal means for bearing mounting.

7. The method of claim 1 in which said bit body is employed as part of a percussion drill.

8. The method of claim 1 in which said bit body is employed as part of a reamer.

9. A new article of manufacture comprising a unitary steel body equipped with a plurality of tungsten-cobalt carbide elements projecting partially therefrom and having portions disposed inwardly of the exterior of said body, the portions of said elements internal of said body being equipped with a coating of a carbide having a cation selected from Groups III and IV of the Periodic Table and characterized by the substantial absence of migratory tungsten, cobalt and carbon in the steel phase and iron in the tungsten carbide phase, said elements having a contour to provide an internal lock with said steel phase.

10. The structure of claim 9 in which said coating includes titanium carbide and titanium nitride.

11. The structure of claim 9 in which said coating includes hafnium carbide.

12. The structure of claim 9 in which the coating has a thickness of the order of about 10 to about 50 microns.

* * * * *